US005547343A

United States Patent [19]

Jané et al.

[11] Patent Number: 5,547,343

[45] Date of Patent: Aug. 20, 1996

[54] TABLE FAN WITH VISE CLAMP

[75] Inventors: Rodney Jané, Westboro; John Longan, Natick, both of Mass.; Jui-Shang Wang, Taipei, Taiwan; Stanley Gresens, Homewood, Ill.

[73] Assignee: Duracraft Corporation, Southborough, Mass.

[21] Appl. No.: 409,394

[22] Filed: Mar. 24, 1995

[51] Int. Cl.[6] ..... F04D 29/64

[52] U.S. Cl. ..... 416/246; 248/231.51

[58] Field of Search ..... 416/246, 247 R; 248/231.1, 231.2, 231.5, 231.6, 231.7, 231.51; D23/381, 382

[56] References Cited

U.S. PATENT DOCUMENTS

| | | | |
|---|---|---|---|
| D. 326,148 | 5/1992 | Lawlor | D23/382 |
| 4,799,858 | 1/1989 | Shin-Chin | 416/246 |
| 4,850,804 | 7/1989 | Huang | 416/246 |

OTHER PUBLICATIONS

Winnower Fan Company Inc. brochure, "Series 2120 L'tl Clippie", 1 page Mar. 1986.

Tatung Company of America, Inc. brochure, "Clip–On Fan", 2 sheets Jan. 1992.

*Primary Examiner*—James Larson

*Attorney, Agent, or Firm*—John E. Toupal; Harold G. Jarcho

[57] ABSTRACT

A portable electric fan including a housing defining an air inlet opening and an air outlet opening; a fan blade rotatably mounted within the housing and operable to produce air flow between the inlet opening and the outlet opening; an electric motor operatively coupled to the fan blade; a support attached to the housing; and a base retaining the support and defining a substantially planar support surface for engaging a substantially horizontal foundation surface, the base and surface adapted to stabily support the electric fan on the foundation surface. Also included with the fan is a clamp manually activatable into clamping engagement with a mounting so as to support the electric fan therefrom.

28 Claims, 5 Drawing Sheets

TABLE FAN WITH VISE CLAMP

BACKGROUND OF THE INVENTION

This invention relates generally to a portable electric fan and, more particularly, to a portable electric fan that can be stabily mounted in a wide variety of locations.

Portable electric fans are used extensively to enhance personal comfort by inducing air movement. Included above the wide variety of portable electric fans are so called floor and table fans used in various residential, commercial and industrial applications. Floor fans typically are supported on a floor surface of an enclosure while table fans typically are supported on planar surfaces provided, for example by tables, desks, or the like. Also known are portable fans having clamping mechanisms that facilitate mounting in locations where a convenient planar mounting surface is not available. Although each of the above portable fan types is useful for limited specific applications, prior portable electric fans have not been functional in many of the diverse conditions for which air movement is desired.

The object of this invention, therefore, is to provide a portable electric fan that can be used conveniently to provide air flow in a large number of varied situations.

SUMMARY OF THE INVENTION

The invention is a portable electric fan including a housing defining an air inlet opening and an air outlet opening; a fan blade rotatably mounted within the housing and operable to produce air flow between the inlet opening and the outlet opening; an electric motor operatively coupled to the fan blade; a support attached to the housing; and a base retaining the support and defining a substantially planar support surface for engaging a substantially horizontal foundation surface, the base and surface adapted to stabily support the electric fan on the foundation surface. Also included with the fan is a clamp manually activatable into clamping engagement with a mounting so as to support the electric fan therefrom. Use flexibility of the fan is enhanced by the combination of both a stable base and an attachment clamp.

According to one feature of the invention, the clamp is retained by the base. Combining the base and clamp provides a compact and efficient support structure.

According to another feature of the invention, the clamp is a vise having a pair of jaws for engaging opposing surfaces of the mounting, and an actuator means producing relative movement between the jaws. The vise provides secure mounting of the fan in situations in which a convenient level support surface is unavailable.

According to yet another feature of the invention, the jaws project laterally from the base in directions susbtantially parallel to the support surface. This feature facilitates desirable orientations when the fan is used in a clamped mode.

According to still another feature of the invention, the support is rotatably mounted on the base. This feature permits rotational adjustment of the fan when used in a clamped mode.

According to a further feature of the invention, the base and one of the jaws are an integrally formed molded unit, and another of the jaws is movable relative thereto. Compactness and reduced costs are achieved with this feature.

According to an additional feature of the invention, the base has a maximum lateral width at least one-half the maximum width of the housing. The provision of a base with substantial relative width enhances stability of the fan when used in a base supporting mode.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
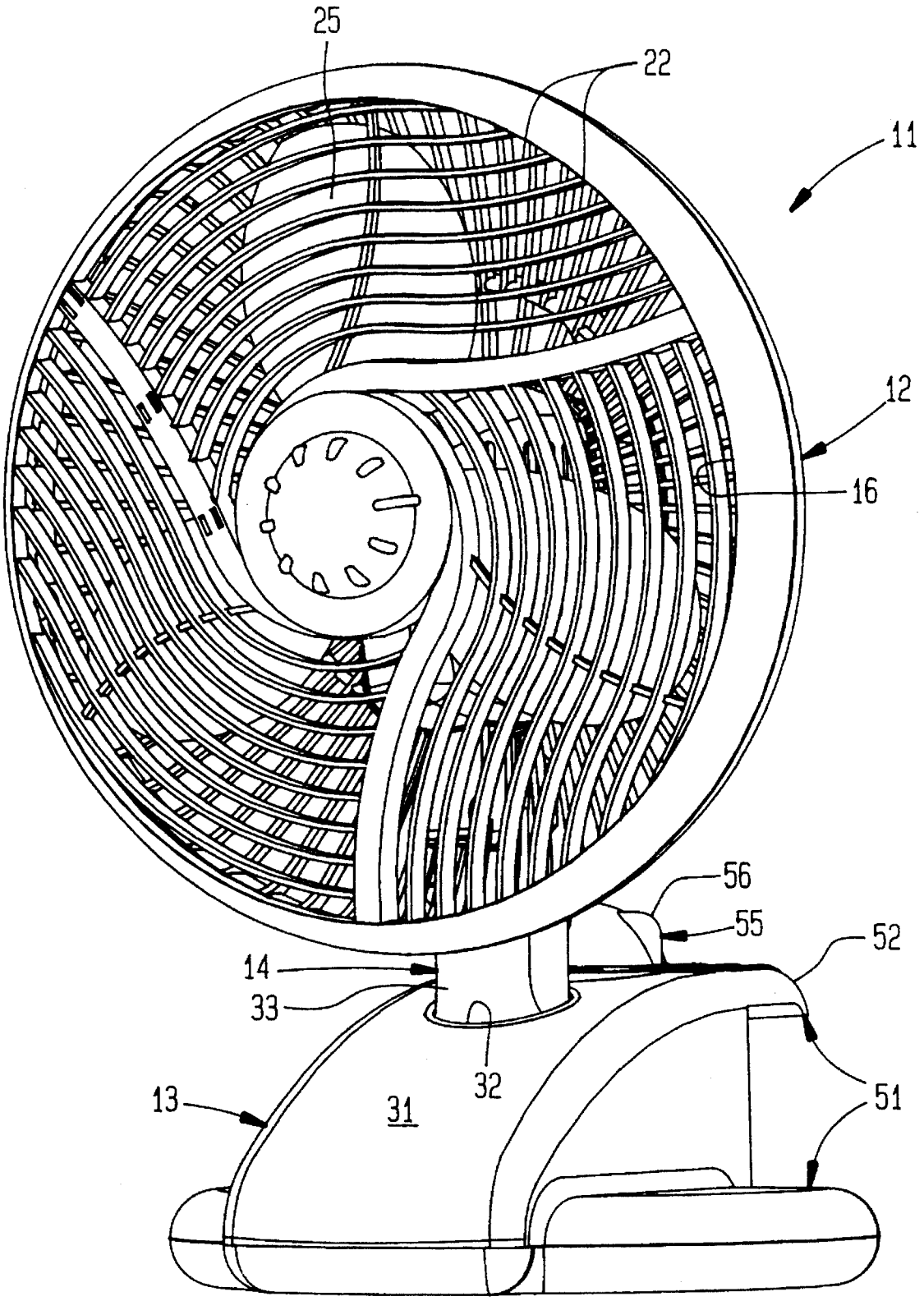
FIG. 1 is a perspective view of a portable electric fan according to the invention.
Figure 2:
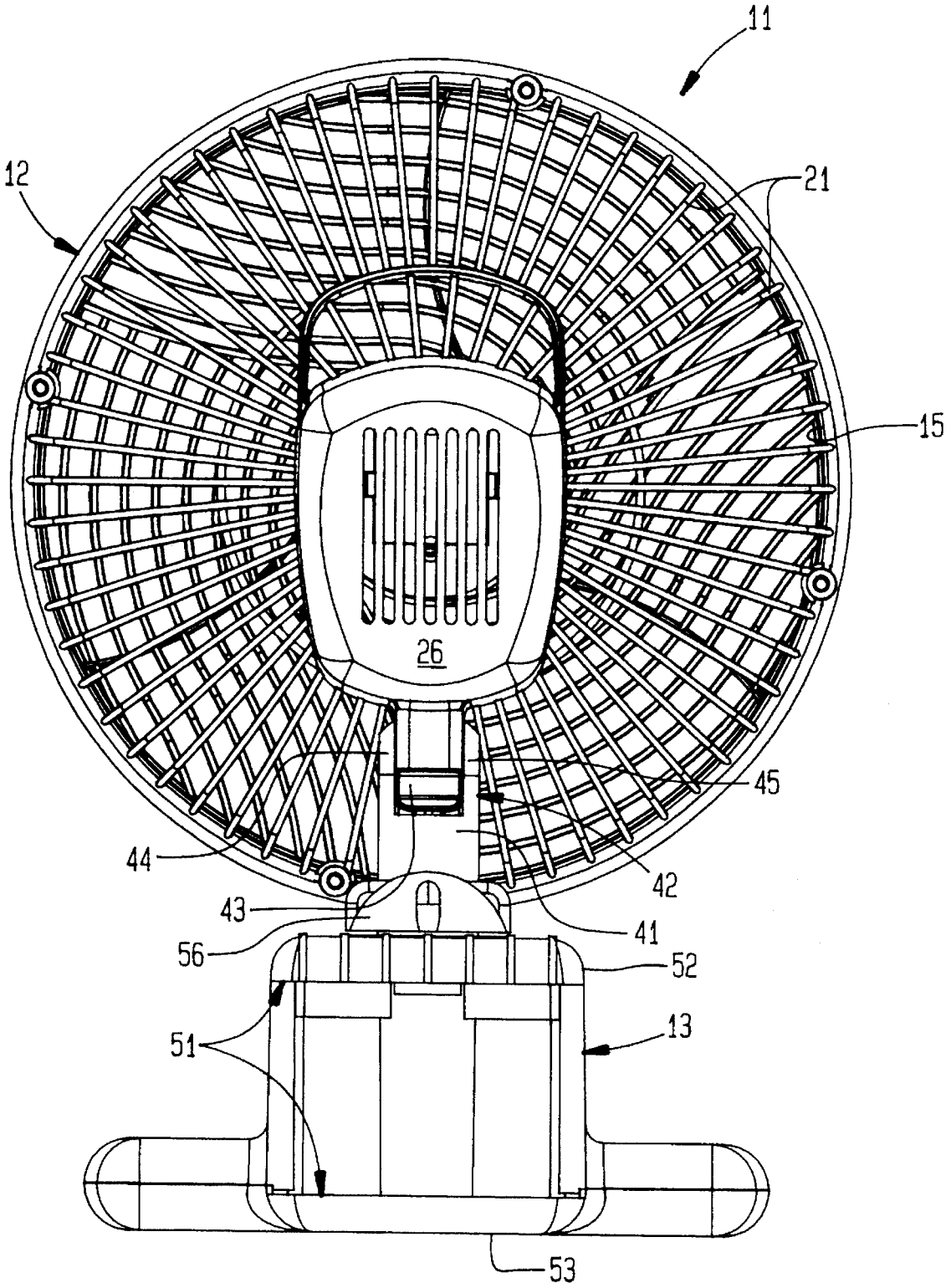
FIG. 2 is a rear view of the fan shown in FIG. 1.

An electric fan appliance 11 has a fan housing 12 supported from a base 13 by an upright support member 14. Defined by the fan housing 12 is an inlet opening 15 and an outlet opening 16 aligned therewith. The inlet opening 15 is covered by a grill 21 while the outlet opening 16 is covered by a grill 22. Rotatably mounted within the fan housing 12 is an environmental conditioning fan blade 25 that can be rotated to induce air flow between the inlet opening 15 and the outlet opening 16. An electric motor 26 extends out of the fan housing 12 through a central portion of the inlet opening 15 and is operatively coupled to the fan blade 25. The electric motor 26 can be energized to produce rotation of the fan blade 25 by manual actuation of a rotary switch 28 mounted on a central portion of the front grill 22.

Figure 5:
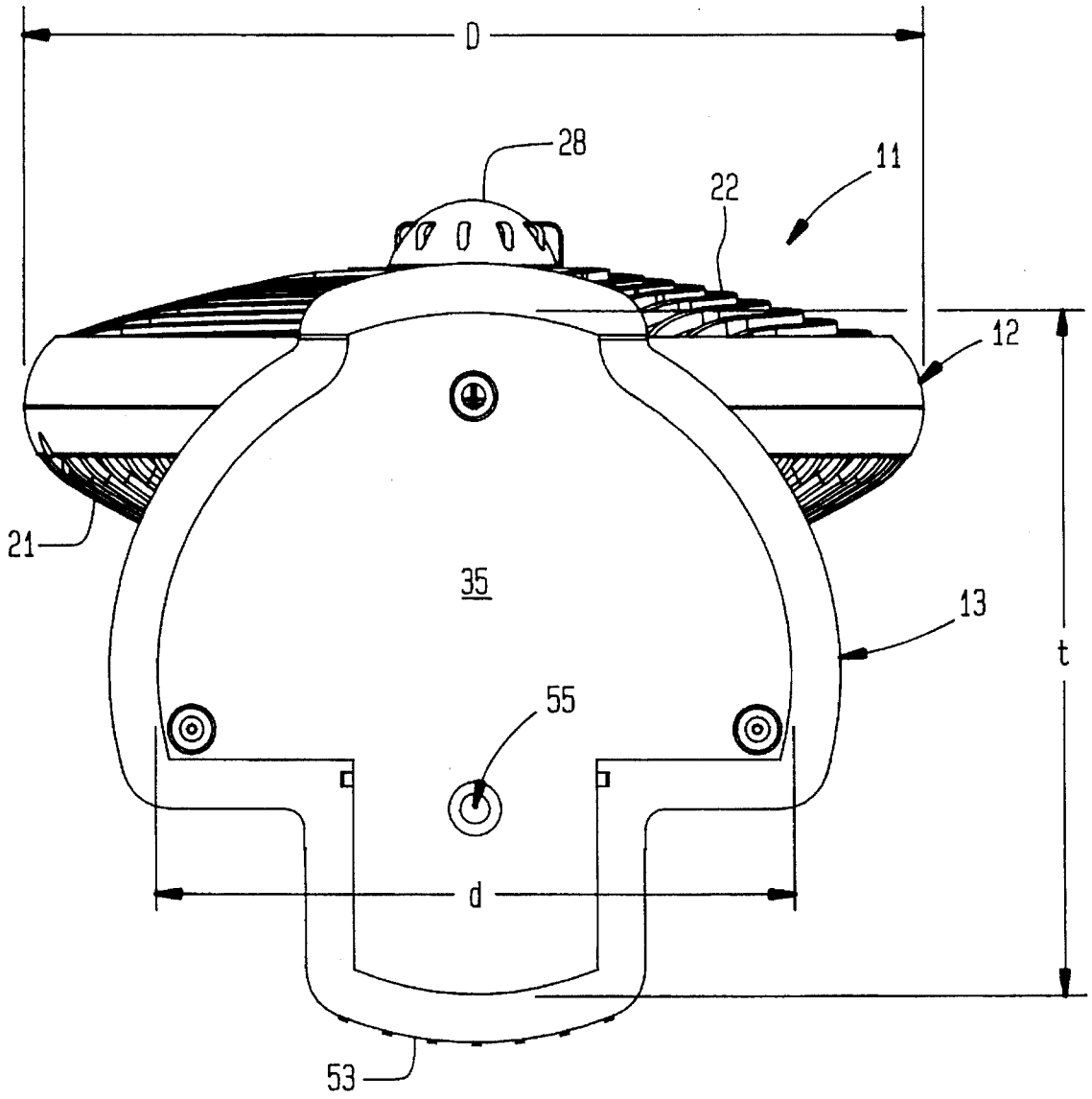
FIG. 5 is a bottom view of the fan shown in FIG. 1.

The base 13 is formed by a molded block having a curved upper surface 31. Defined by the upper surface 31 is a socket 32 that rotationally retains one end 33 of the upright member 14. A bottom of the base 13 defines a planar support surface 35 (FIG. 5) for engaging a substantially horizontal foundation surface provided, for example, by a table top, desk or the like.

An opposite end 41 of the upright member 14 terminates with a yoke portion 42 having bifurcated legs 44 and 45. Received by the yoke portion 42 is a flange 43 extending downwardly from the motor 26. The flange 43 and the yoke 42 are connected by a pin 47 that extends through apertures in the legs 44, 45 and the flange 43 and permits pivotal movement of the fan 12 on the upright member 14. Manually induced rotation of the upright member 14 in the base 13 permits rotational positioning with respect thereto of the fan housing 12.

Also included with the electric fan 11 is a vise clamp assembly 51 that is supported by the base 13. The vise 51 includes a pair of separate, spaced apart jaws 52, 53 that project laterally from the base 13 in directions parallel to the support surface 35. Another component of the vise clamp assembly 51 is a jack screw 55 which connects the jaws 52 and 53 and produces relative translational movement therebetween. The jackscrew 55 has an end rotationally retained by the base 13 and a shank portion threadedly engaging the upper jaw 52. A knob 56 attached to an outer end of the jack screw 55 and projecting upwardly from the base 13 can be rotated to produce translational movement of the upper jaw 52 toward the lower jaw 53. Preferably, the jaw 53 is molded with the base 13 as an integral unit.

During use, the electric fan 11 is positioned in a location in which air movement is desired. Typically, the fan 11 is placed on a suitable foundation surface provided, for example, by a desk or table top. The planar surface 35 on the bottom of the base 13 which has substantial width provides for the fan 11 a high degree of stability. Preferably, the base 13 has maximum orthogonally related dimensions t and d (FIG. 5) each at least one-half the maximum width D of the circular fan housing 12.

Figure 3:
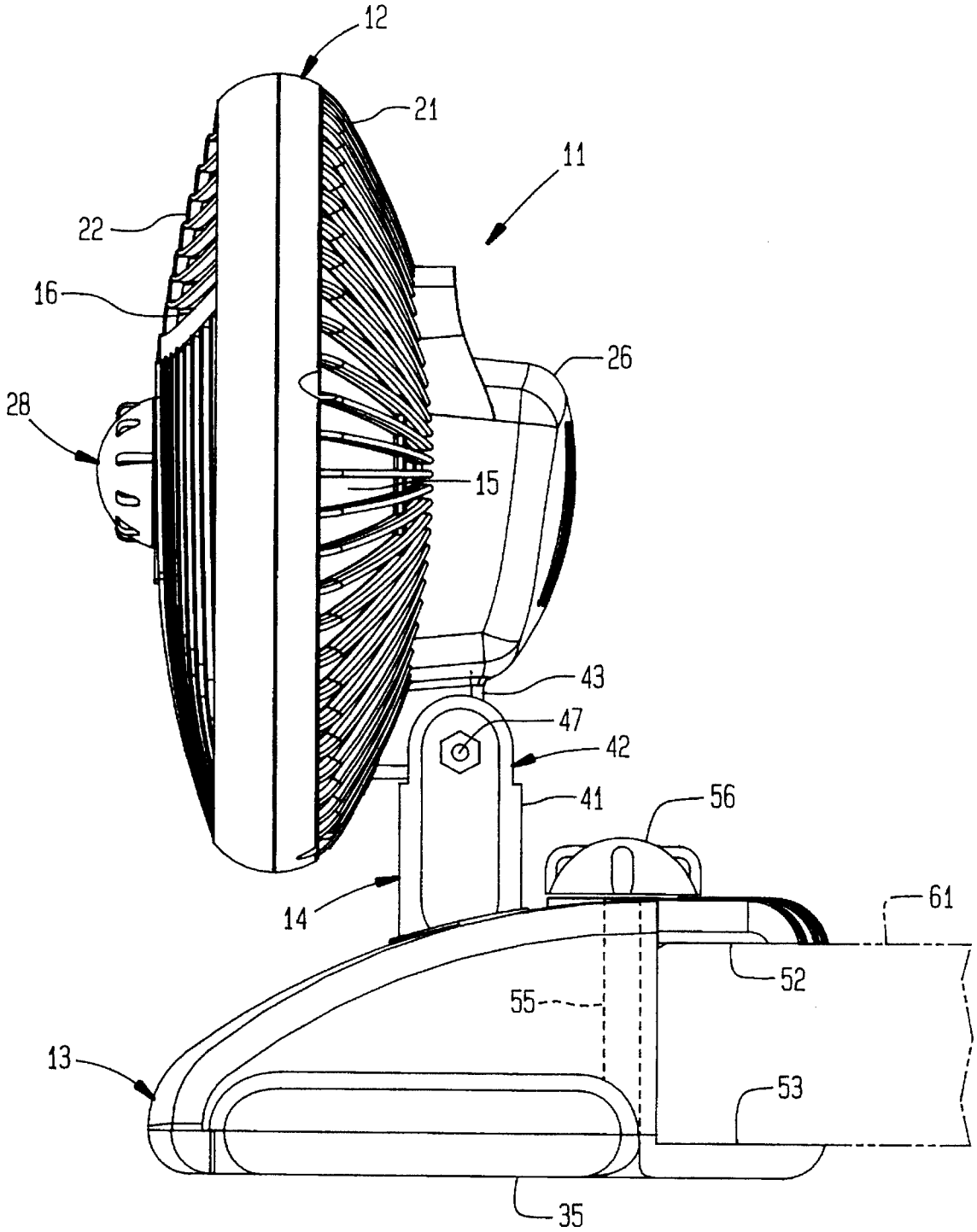
FIG. 3 is a right, side elevational view of the fan shown in FIG. 1.
Figure 4:
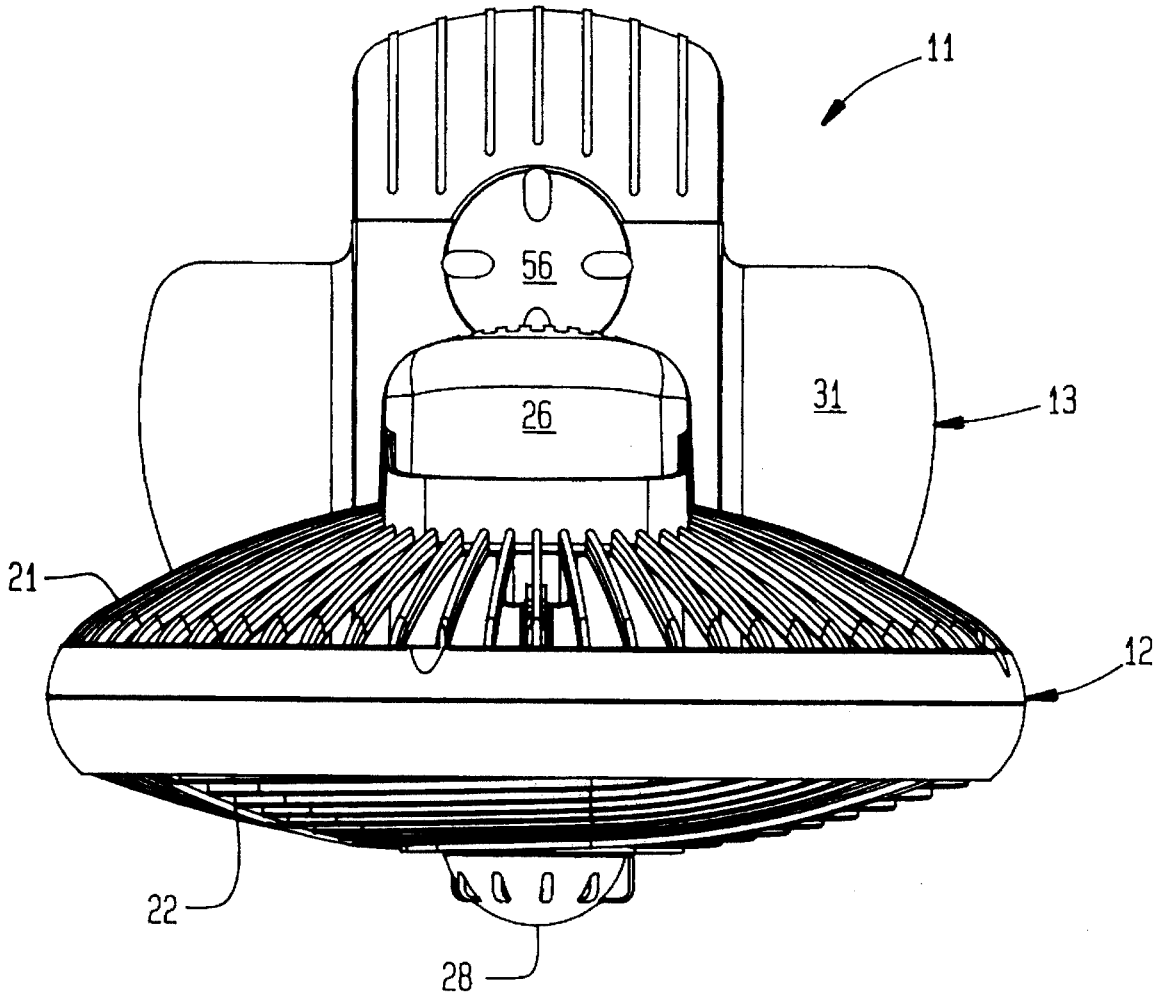
FIG. 4 is a top view of the fan shown in FIG. 1.

Alternatively, in the absence of a convenient foundation surface for the base 13, the vise clamp 51 is employed to secure the electric fan 11 to a suitable mounting provided, for example, by a relatively thin structural member 16 (FIG. 3) such as a table top, shelf or the like. For this application, the upper and lower jaws 52, 53 are passed over an outer edge of the member 16 to produce engagement thereof with the base 13. The knob 56 on the jack screw 55 then is manually turned to produce closure movement of the upper jaw 52 toward the lower jaw 53 until they firmly engage the mounting member 61.

Obviously, many modifications and variations of the present invention are possible in light of the above teachings. For example, the planar support surface 35 on the base 13 could be provided by ends of three legs. It is to be understood, therefore, that the invention can be practiced otherwise than as specifically described.

What is claimed is:

1. A portable electric fan comprising:

housing means defining an air inlet opening and an air outlet opening;

a fan blade rotatably mounted within said housing means and operable to produce air flow between said inlet opening and said outlet opening;

an electric motor operatively coupled to said fan blade;

support means attached to said housing means;

base means retaining said support means and defining a substantially planar support surface means for engaging a substantially horizontal foundation surface, said base means and surface means adapted to stably support said electric fan on the foundation surface; and vise means attached to said electric fan and manually activatable into clamping engagement with a mounting so as to support said electric fan therefrom.

2. An electric fan according to claim 1 wherein vise means is retained by said base means.

3. An electric fan according to claim 1 wherein said vise means comprises a pair of jaws for engaging opposing surfaces of the mounting, and a manually operated actuator means for producing relative closure movement between said jaws.

4. An electric fan according to claim 3 wherein said vise means is attached to said base means.

5. An electric fan according to claim 4 wherein said jaws project laterally from said base means in directions substantially parallel to said support surface means.

6. An electric fan according to claim 5 wherein said actuator means is a jack screw retained by said base means and said vise means.

7. An electric fan according to claim 1 wherein said support means is rotatably mounted on said base means.

8. An electric fan according to claim 7 wherein said vise means comprises a pair of jaws for engaging opposing surfaces of the mounting, and a manually operated actuator means for producing relative closure movement between said jaws.

9. An electric fan according to claim 8 wherein said vise means is attached to said base means.

10. An electric fan according to claim 9 wherein said jaws project laterally from said base means in directions substantially parallel to said support surface means.

11. An electric fan according to claim 10 wherein said actuator means is a jack screw retained by said base means and said vise means.

12. An electric fan according to claim 7 wherein said support means comprises an upright member having one end rotatably mounted on said base means and an opposite end attached to said housing means.

13. An electric fan according to claim 12 wherein said housing means is pivotally attached to said opposite end of said upright member.

14. An electric fan according to claim 7 wherein said support surface means comprises a bottom portion of said base means.

15. An electric fan according to claim 3 wherein said base means and one of said jaws are an integrally formed molded unit, and another of said jaws is movable relative thereto.

16. An electric fan according to claim 1 wherein said housing means is pivotally attached to said support means.

17. An electric fan according to claim 1 wherein said support surface means has maximum orthogonally related dimensions each at least one-half the maximum width of the housing means.

18. A portable electric appliance comprising:

housing means defining an air inlet opening and an air outlet opening;

environmental conditioning means mounted within said housing means;

support means attached to said housing means;

base means retaining said support means and defining a substantially planar support surface means for engaging a substantially horizontal foundation surface, said base means and surface means adapted to stably support said appliance on the foundation surface; and vise means attached to said appliance and manually activatable into clamping engagement with a mounting so as to support said appliance therefrom.

19. An appliance according to claim 18 wherein said vise means is retained by said base means.

20. An appliance according to claim 18 wherein said vise means comprises a pair of jaws for engaging opposing surfaces of the mounting, and a manually operated actuator means for producing relative closure movement between said jaws.

21. A portable electric fan comprising:

housing means defining an air inlet opening and an air outlet opening;

a fan blade rotatably mounted within said housing means and operable to produce air flow between said inlet opening and said outlet opening;

an electric motor operatively coupled to said fan blade;

support means attached to said housing means;

base means retaining said support means and defining a substantially planar support surface means for engaging a substantially horizontal foundation surface, said surface means having maximum orthogonally related dimensions each at least one-half the maximum width of said housing means, and wherein said base means and surface means are adapted to stably support said electric fan on the foundation surface; and clamp means attached to said electric fan and manually activatable into clamping engagement with a mounting so as to support said electric fan therefrom.

22. An electric fan according to claim 21 wherein said clamp means is retained by said base means.

23. An electric fan according to claim 21 wherein said support surface means comprises a bottom portion of said base means.

24. A portable electric appliance comprising:

housing means defining an air inlet opening and an air outlet opening;

environmental conditioning means mounted within said housing means;

support means attached to said housing means;

base means retaining said support means and defining a substantially planar support surface means for engaging a substantially horizontal foundation surface, said surface means having maximum orthogonally related dimensions each at least one-half the maximum width of said housing means, and wherein said base means and surface means adapted to stably support said appliance on the foundation surface; and clamp means attached to said appliance and manually activatable into clamping engagement with a mounting so as to support said appliance therefrom.

25. An appliance according to claim 24 wherein said clamp means comprises vise means.

26. An appliance according to claim 25 wherein said vise means comprises a pair of jaws for engaging opposing surfaces of the mounting, and manually operated actuator means for producing relative closure movement between said jaws.

27. An electric fan according to claim 24 wherein said clamp means is retained by said base means.

28. An electric fan according to claim 24 wherein said support surface means comprises a bottom portion of said base means.

* * * * *